United States Patent [19]

Salvino

[11] Patent Number: 5,058,901

[45] Date of Patent: Oct. 22, 1991

[54] SPIN AXIS WEIGHTED BOWLING BALL

[76] Inventor: Carmen M. Salvino, 2658 N. New England, Chicago, Ill. 60635

[21] Appl. No.: 540,838

[22] Filed: Jun. 20, 1990

[51] Int. Cl.[5] ..... A63B 37/10

[52] U.S. Cl. ..... 273/63 E; 273/63 C

[58] Field of Search ..... 273/63 E, 63 R, 63 C, 273/63 A, 63 B, 63 D, 63 F

[56] References Cited

U.S. PATENT DOCUMENTS

| | | | |
|---|---|---|---|
| 189,674 | 4/1877 | Woods | 273/63 A |
| 447,011 | 2/1891 | Harman | 273/63 A |
| 533,011 | 1/1895 | Huntoon | 273/63 A |
| 580,207 | 4/1897 | Boemermann et al. | 273/63 A |
| 626,584 | 6/1899 | Wilmerling | 273/63 A |
| 673,688 | 5/1901 | Pickett | 273/63 A |
| 712,192 | 10/1902 | Immen | 273/63 A |
| 746,576 | 12/1903 | Rice | 273/63 E |
| 950,838 | 3/1910 | Cavanagh | 273/63 A |
| 1,021,490 | 3/1912 | Scully | 273/63 A |
| 1,217,940 | 3/1917 | Hill | 273/63 A |
| 2,273,199 | 2/1942 | Hilton et al. | 273/63 A |
| 2,291,738 | 8/1942 | Luth et al. | 273/63 E |
| 2,362,269 | 11/1944 | Hall | 273/63 E |
| 2,393,026 | 1/1946 | Dietz et al. | 273/63 A |
| 2,414,672 | 1/1947 | Sauer | 273/63 A |
| 2,839,301 | 6/1958 | Hunter | 273/63 R |
| 3,270,108 | 8/1966 | Randolph | 273/63 E X |
| 3,329,429 | 7/1967 | Kopperud | 273/63 A |
| 3,441,274 | 4/1969 | Collins | 273/63 E |
| 3,865,369 | 2/1975 | Randolph | 273/63 E |
| 4,121,828 | 10/1978 | Amburgey | 273/63 E |
| 4,150,822 | 4/1979 | Beckman | 273/63 B |
| 4,320,899 | 3/1982 | Salvino | 273/63 E |
| 4,523,757 | 6/1985 | Swett et al. | 273/63 E |
| 4,913,429 | 4/1990 | Fabanich | 273/63 E |

FOREIGN PATENT DOCUMENTS

| | | | |
|---|---|---|---|
| 108100 | 7/1917 | United Kingdom | 273/63 E |

*Primary Examiner*—George J. Marlo

*Attorney, Agent, or Firm*—Fay, Sharpe, Beall, Fagan, Minnich & McKee

[57] ABSTRACT

A bowling ball comprises a core, a cover surrounding the core, and a weighting rod for increasing the weight density of the bowling ball along the spin axis, thereby reducing the bowling balls moment of inertia about the spin axis. To modify the trajectory of the ball's hook, or arc, on the bowling alley lane, the rod's weight may be offset so that one side of the bowling ball is heavier than the other side. The biased nature of the weight causes the bowling ball to develop precession, and improve the hooking nature of the trajectory.

4 Claims, 7 Drawing Sheets

FIG. 7
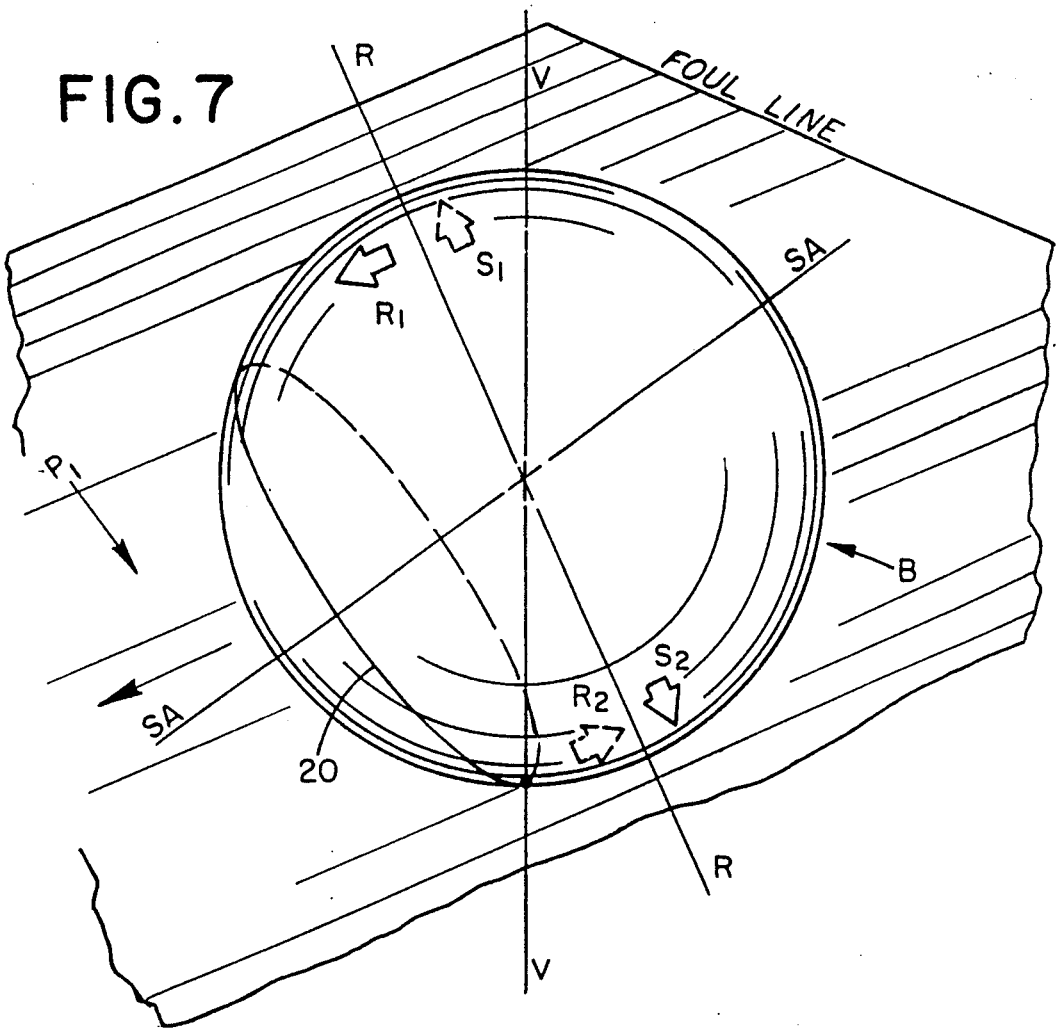
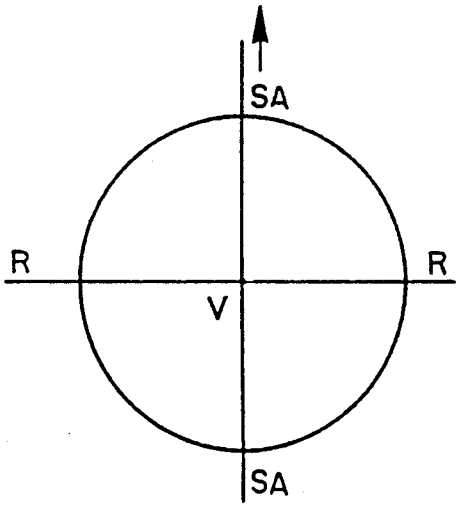
FIG. 8
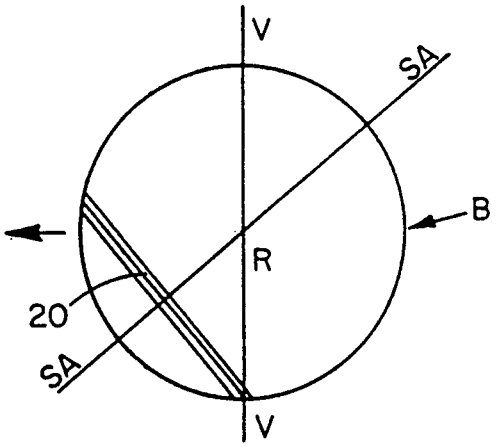
FIG. 9

SPIN AXIS WEIGHTED BOWLING BALL

BACKGROUND OF THE INVENTION

1. Field of the Invention

This invention pertains to the art of sporting balls thrown or rolled by hand and more particularly to bowling balls.

2. Description of the Related Art

Many games and sports popularly enjoyed by enthusiasts require the use of a hand-held ball which is rolled or thrown. Among these games, one of the more popular is that of bowling. In bowling, one rolls a round ball toward a number of pins, with the object being to knock down as many pins as possible. The player knocking down the most pins obtains the highest score and thereby wins the bowling game.

The bowling ball which is in popular use in this country must meet rigid standards promulgated by the American Bowling Congress. Among these standards is the requirement that the weight of the bowling ball must not exceed sixteen pounds and must not differ more than one ounce from side to side, and must not differ more than three ounces top to bottom. Further, the outside diameter of the bowling ball must be between 8.550 and 8.59 inches.

The bowling ball is commonly drilled to provide a grip for the bowler. Conventional grips include the two hole and three hole grip. A two hole grip accommodates the thumb and middle finger of the bowler while a three hole grip accommodates the thumb, ring finger, and middle finger of the bowler. In a three hole grip, the holes for the ring finger and middle finger may be drilled to a shallow depth (i.e., to the first knuckle) to provide a fingertip grip or more deeply (i.e., to the second knuckle) to provide a conventional grip. Alternately, grips for which the fingers are inserted to intermediate positions between the first and second knuckle are referred to as semi-fingertip grips. The drilling of holes in the ball necessarily removes material from the ball. This creates an unbalanced condition in what would otherwise be a homogeneous bowling ball of constant weight density throughout.

Various methods and apparatuses have been proposed in the prior art to compensate for the weight removed by drilling finger and thumb holes. The majority of prior designs endeavored to statically balance the bowling ball by compensating for the weight removed by the finger and thumb holes. In at least one patent, namely U.S. Pat. No. 4,320,899 to Salvino which is incorporated herein by reference, weight blocks are positioned in the bowling ball to dynamically balance the bowling ball.

A bowling ball that is dynamically unbalanced will wobble as it rolls down the bowling lane. Such a dynamically unbalanced bowling ball will make it more difficult for the bowler to control, and therefore more difficult for him to consistently obtain high scores.

Another impediment to consistent high scoring is the deflection of the bowling ball's path after it impacts the first bowling pin. In the case of an accurately thrown bowling ball, the bowling ball will impact the pocket (i.e., the number 1 and number 3 Pins for a right-handed bowler and number 1 and number 2 for a left-handed bowler) and begin crashing into secondary and tertiary rows of pins. It is advantageous for the bowling ball to deflect as little as possible from these primary and secondary impacts so that the ball will continue to follow its intended arc.

It is a general object of this invention to provide a bowling ball which includes weight on the spin axis of the bowling ball having certain properties and positions relative to the spin axis so that the stability of the ball as it spins down the lane, as well as the arc of the ball's trajectory, are improved to provide consistently high scores for the skilled bowler.

SUMMARY OF THE INVENTION

In accordance with the present invention, a new and improved bowling ball is provided which features weighting means on the spin axis of the bowling ball.

More particularly, in accordance with the invention, a bowling ball has a center and when spinning has a ball track plane and a spin axis. The spin axis is a line perpendicular to the ball track plane. The bowling ball comprises a core, a cover surrounding the core and having an outer surface, and weighting means for increasing the weight density of the bowling ball along the spin axis.

In accordance with another aspect of the invention, the core is of substantially equal weight density throughout.

According to another aspect of the invention, the cover is of substantially equal weight density throughout.

According to another aspect of the invention, the weighting means is a weight block placed within the core on the spin axis.

According to another aspect of the invention, the weighting means is a weight placement within the core on the spin axis.

According to another aspect of the invention, the weighting means is a rod whose centerline is coincident with the spin axis, the rod having a homogeneous weight density distribution so that one-half of the rod weighs substantially the same as the other half of the rod. Accordingly to another aspect of the invention, the weighting means for increasing the weight density of the bowling ball along the spin axis reduces the bowling ball's movement of inertia about the spin axis.

According to a still further aspect of the invention, the bowling ball features biasing means for biasing the weight density of the ball along the spin axis. The biasing means is located on the spin axis.

According to another aspect of the invention, the biasing means is a weight block placed within the core between the center of the bowling ball and the cover.

According to another aspect of the invention, a second weight block is located on the spin axis on the opposite side of the center than the first weight block.

According to another aspect of the invention, the biasing means is a rod whose centerline is coincident with the spin axis and which has a heterogeneous weight density distribution so that one half of the rod weighs more than the other half of the rod.

According to another aspect of the invention, the biasing means is operatively adapted for increasing the precession of the bowling ball.

According to a still further aspect of the invention, the bowling ball features a pair of weight blocks disposed within the bowling ball inwardly of the outer surface of the cover. One of the weight blocks is positioned to be intersected by at least one finger hole when drilled into the bowling ball. The other of the weight blocks is positioned to be intersected by a thumb hole when drilled into the bowling ball. The size and location of the weight blocks is such that there is no concentrated residual weight provided by the weight blocks after drilling. Further, the weight density of the core, the weight density of the cover, and the shape and weight density of the weight blocks are such that after drilling, all axes of the bowling ball may be a spin axis in which the bowling ball's moments of inertia about axes aligned with the spin axis are approximately equal and the products of inertia for all axes perpendicular to the spin axis are small, thereby producing a stable trajectory for the bowling ball as it slides and rolls down the bowling lane.

One advantage of the present invention is the provision of weighting means on the spin axis which tends to lower the bowling ball's moment of inertia about the spin axis. This results in a more stable trajectory and a lessening of dynamic imbalance during the spinning phase of the ball's trajectory down the bowling lane.

Another advantage of the present invention that is due to the lower moment of inertia about the bowling ball's spin axis is increased precession. Because the bowling ball's moment of inertia about the spin axis is lower, due to the concentration of weight along the spin axis, the physical phenomenon of precession is more operative. The precession causes the radius of the curvature of the bowling ball's arc to be smaller, causing the ball to "hook" more and to hit the pocket with more advantageous results.

Another advantage of the invention is the provision of a biasing means whereby the trajectory and curvature of the ball's arc may be modified by intentionally creating a state of imbalance along the spin axis. By placing the heavier side of the spin axis on the positive side of the bowling ball, the curvature of the arc for a right-handed bowler is smaller, causing the ball to hook more and hit the pocket with more advantageous results.

Another advantage of the present invention is the provision of weight blocks to compensate for the weight removed by the drilling of the thumb and finger holes. The provision of these weight blocks restores the ball to a dynamically balanced condition as described in U.S. Pat. No. 4,320,899 to Salvino.

Still another advantage of the invention is the provision of a weight block design which enables the bowling ball of this invention to be drilled for either a right-handed or left-handed bowler.

Still another benefits and advantages of the invention will become apparent to those skilled in the art upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein:

FIG. 7 is a schematic, perspective, view of the forces and moments which act on the bowling ball as it rolls and slides down the lane;

FIG. 8 is a schematic plan view of the forces and moments which act on the bowling ball as it rolls and slides down the lane;

FIG. 9 is a schematic side view of the forces and moments which act on the bowling ball as it rolls and slides down the lane;

DESCRIPTION OF THE PREFERRED EMBODIMENT

Figure 1:
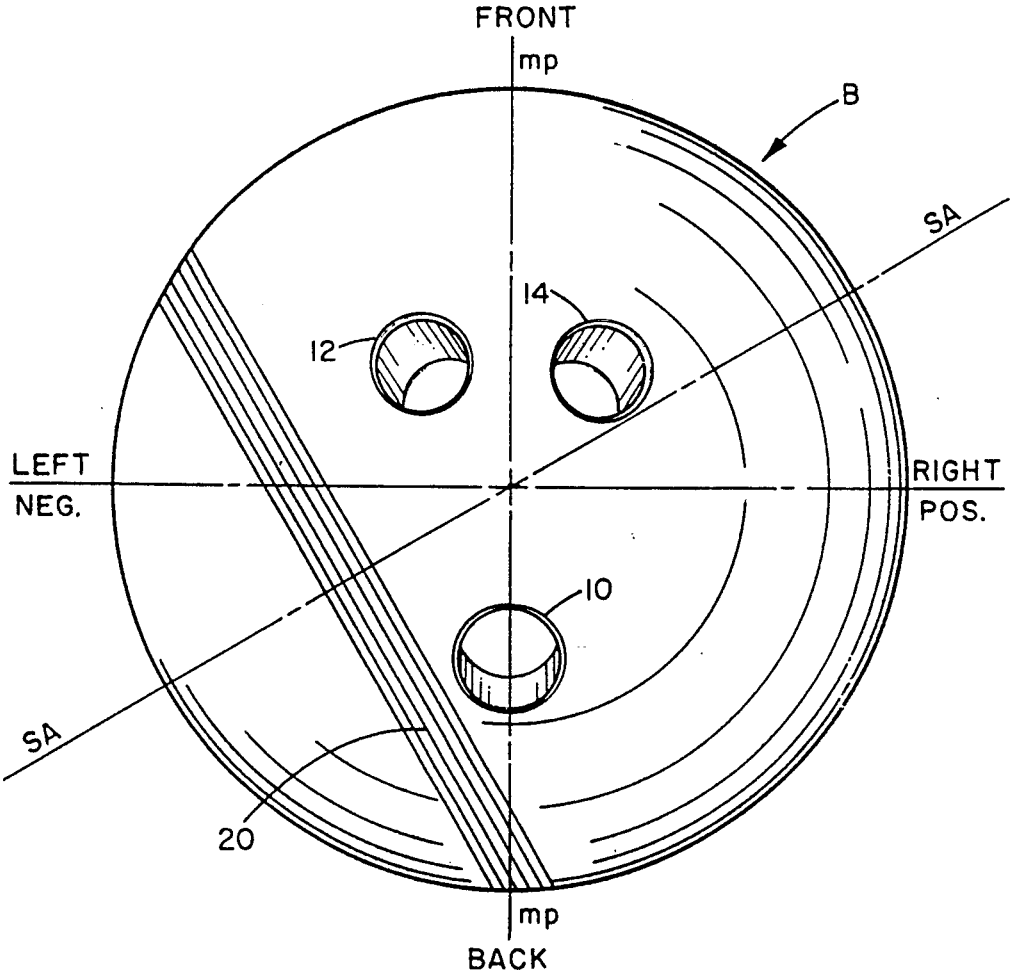
FIG. 1 is a schematic plan view of a bowling ball with a ball track.

Referring now to the drawings wherein the showings are for purposes of illustrating a preferred embodiment of the invention only and not for purposes of limiting same, FIG. 1 shows a typical bowling ball B which features three drilled holes. A midplane MP of the bowling ball passes through the center of a thumb hole 10 and bisects a line segment between the center of a middle finger hole 12 and a ring finger hole 14. For a right-handed bowler, the area on the right half of the midplane is called the positive side of the ball while the area on the left side of the midplane is called the negative side of the ball.

In the case where a consistent bowler uses the same bowling ball for a length of time, a distinguishing wear pattern called a ball track 20 will begin to appear. Because the ball is spinning as it leaves the bowler's hand, and because lanes are generally oiled, the ball tends to slide along the lane for a length of time before friction between the ball and the lane causes the ball to begin rolling down the lane. The sliding of the ball relative to the lane causes the wear marks known as the ball track 20. The width of the ball track can vary due to factors such as the consistency of the bowler and the dynamic stability of the bowling ball. For discussion purposes, the ball track can be considered as being in a plane which is centered in the middle of the ball track. Perpendicular to the plane containing the ball track 20 is a line called the spin axis SA. When the ball is spinning and sliding down the lane, it revolves around the spin axis SA.

Analysis of the ball track 20 reveals certain facts to the experienced bowler. Bowlers generally use one of four primary delivery styles, each of which has a distinctive ball track. In a "full roller" delivery, the ball track 20 is located on the "great circle" of the bowling ball. The great circle is a term referring to a circle on the surface of the bowling ball which is of maximum diameter. Another variety of the full roller is known as a "full roller outside fingers and thumb". In this case, the ball track 20 is located not on a great circle, but on the largest circle possible which falls outside the finger and thumb holes. The third primary delivery style is a "$\frac{3}{4}$ roller". In this case, the ball track 20 has a smaller diameter of than that of the full roller or the full roller outside fingers and thumb. The final delivery style is the "spinner". In a spinner delivery, the ball track 20 is of relatively small diameter. In each of the four delivery styles, the spin axis SA is perpendicular to the plane containing the ball track 20.

The dynamic stability of a bowling ball B can be inferred by the width of the ball track 20. In a bowling ball which is dynamically stable, the ball track 20 tends to be relatively narrow. However, in a bowling ball that is dynamically unstable, the ball track 20 tends to be flared.

The dynamics of the ball's motion as it travels down the lane is described in FIGS. 7–9. When the ball B is delivered from the bowler's hand, the ball is spinning about the spin axis SA, and sliding down the lane 50. The ball is not yet rolling. At some point down the lane 50, the ball's motion begins to change from spinning and sliding to rolling. For purposes of this discussion, this part of the ball's motion will be called "transition". During transition the bowling ball is both spinning and rolling. During this time, the bowling ball is revolving about two axes simultaneously.

Whenever a body rotates about two axes, motion about a third axis results. This motion about the third axis is called "precession".

With continuing reference to FIGS. 7–9, the bowling ball's motion may be conveniently described with resort to three axes. The first axis, denoted SA, is the spin axis of the bowling ball. The second axis, denoted R, passes through the center of the bowling ball and is parallel to the lane surface. This is the axis about which the bowling ball revolves as it rolls. The third axis, denoted V, is a vertical axis passing through the center of the bowling ball which is perpendicular to the rolling axis R.

During transition, the bowling ball B is spinning and sliding on the lane surface. The direction of the spin for a right-hand bowler is illustrated by use of arrows $S_1$ and $S_2$. It should be understood that the directions of $S_1$ and $S_2$ are parallel to the plane of the ball track 20. During transition, the bowling ball is also beginning to roll down the lane. The rolling revolves a revolution of the bowling ball about its rolling axis R. This motion is illustrated by way of arrows $R_1$ and $R_2$.

As discussed above, because the bowling ball is rotating about two axes simultaneously, namely SA and R, it will also rotate about a third axis due to precession. Precession acts on the ball in the direction of arrow $P_1$ and causes the trajectory of the bowling ball to be more curved. This smaller radius of curvature enables the ball to "hook" into the pocket, resulting in greater pin fall and higher scores.

Figure 2:
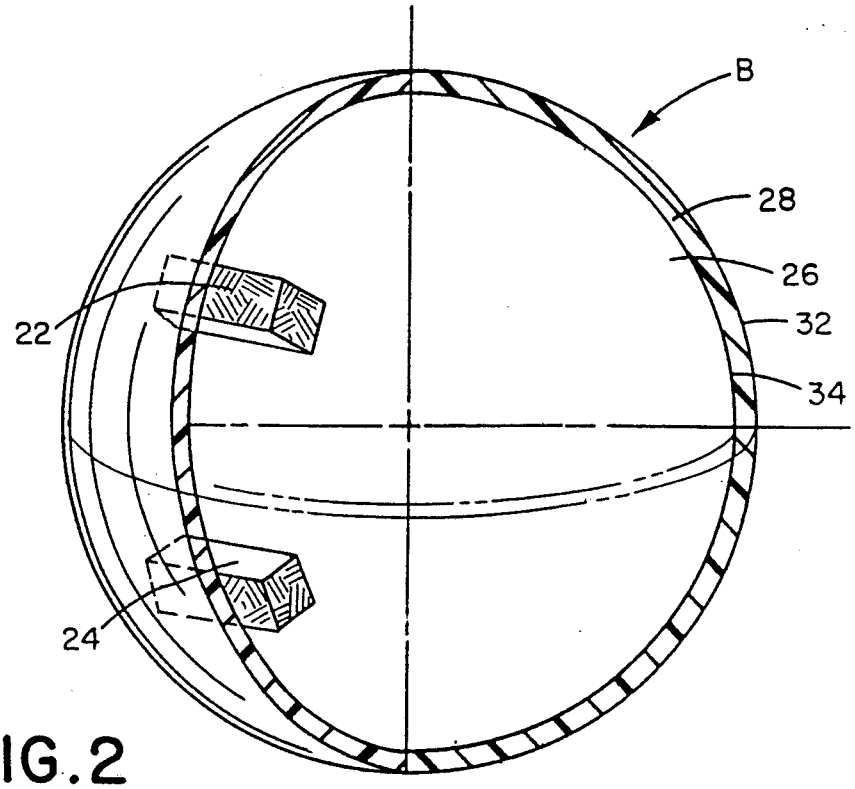
FIG. 2 is a schematic, perspective, partially cross-sectional view of a bowling ball and weight blocks according to the present invention.
Figure 11:
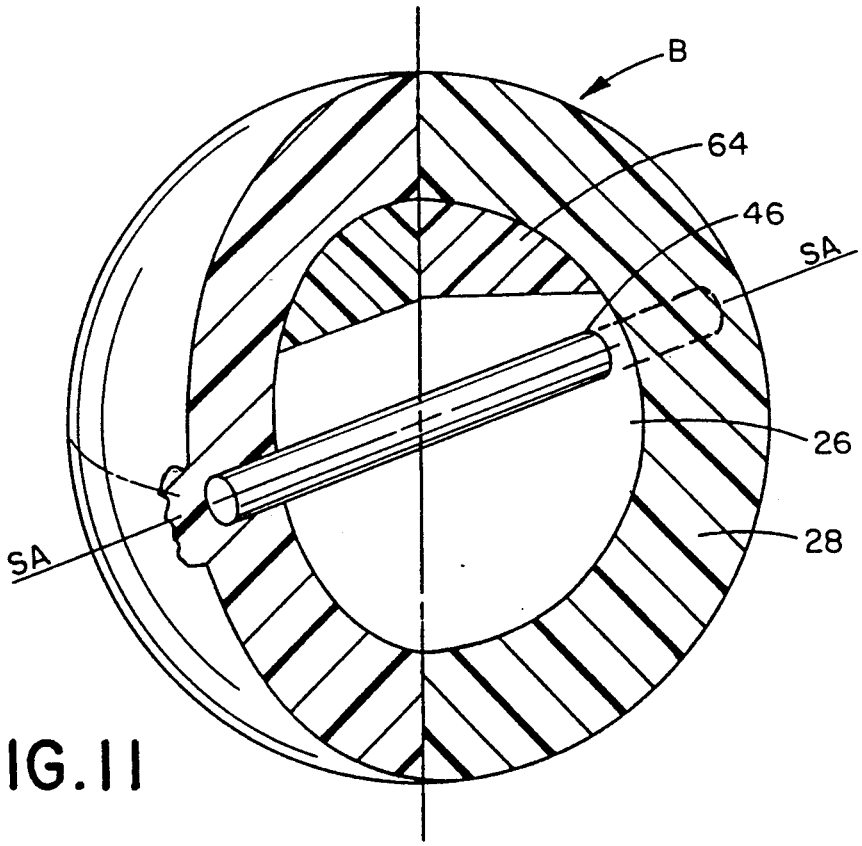
FIG. 11 is a schematic, perspective view of a bowling ball according to another embodiment of the invention.
Figure 12:
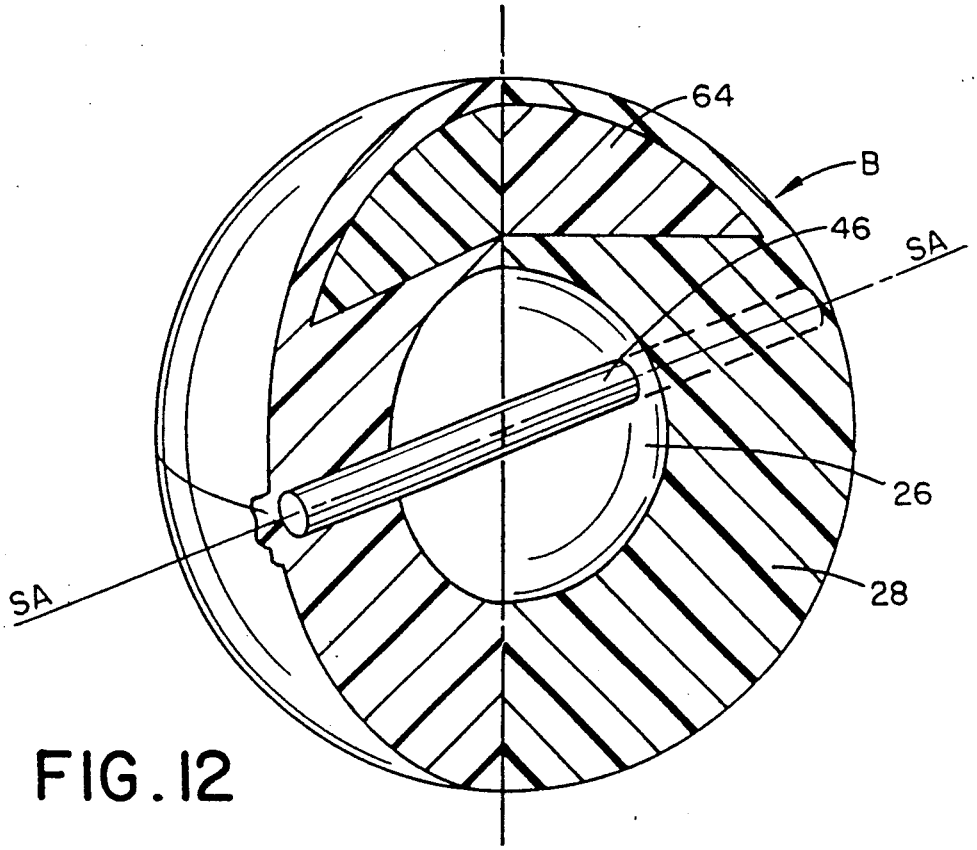
FIG. 12 is a schematic, perspective view of a bowling ball according to another embodiment of the invention.

With reference to FIG. 2, there is disclosed a bowling ball according to the present invention with a pair of weight blocks 22, 24. The bowling ball comprises a core 26 surrounded by a cover 28. The core is preferably made of a material with a homogeneous weight density; in other words, portions of the core having equivalent volumes also have equivalent weights. In the preferred embodiment, the core is made of polyester. The cover 28 is approximately $\frac{1}{4}$ inch thick and is also made of a material having a homogeneous weight density. In the preferred embodiment, the cover is made of polyester. With reference to FIGS. 11 and 12, alternate embodiments of the invention can feature smaller diameter cores 26 with correspondingly thicker covers 28.

Figure 4:
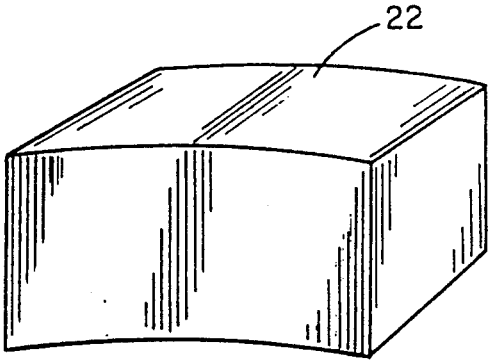
FIG. 4 is a schematic view of a weight block according to the present invention.

The weight blocks 22, 24 are located within an outer surface 32 of the cover 28. In the preferred embodiment, the weight blocks 22, 24 are located near the inside surface 34 of the cover 28 and the core 26. In the preferred embodiment, the weight blocks are curved, as shown in FIG. 4, so that the weight blocks will fit against an inside surface 34 of the cover 28.

Figure 3:
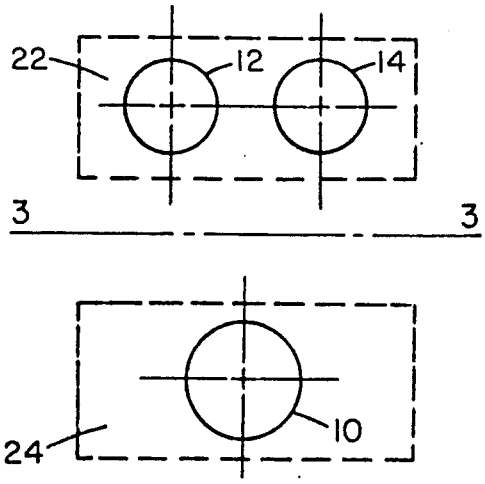
FIG. 3 is a schematic plan view of weight blocks according to the present invention.

In the preferred embodiment, the weight blocks are positioned as shown in FIG. 3 so that they are symmetrical about a line 3—3 passing between the two blocks. Line 3—3 is parallel to the major axis of each of the weight blocks. By making the blocks symmetrical, the bowling ball B can have a weight bias from side to side and still be drilled for either a right-handed or left-handed bowler. For example, FIG. 3 shows weight block 22 drilled for the middle finger hole 12 and the ring finger hole 14. Correspondingly, the weight block 24 is drilled for the thumb hole 10. Assuming this relationship is for a right-handed bowler, the same bowling ball could be drilled for use by a left-handed bowler by drilling finger holes 12, 14 in block 24 and thumb hole 10 in block 22.

The advantages of a biased weighted bowling ball from left to right will be discussed later in the specification. The advantages inherent in the use of weight blocks 22, 24 are detailed in U.S. Pat. No. 4,320,899 which is incorporated here by reference. For purposes of this discussion, it is important to know that weight blocks 22, 24 improve the dynamic stability of the bowling ball, in that the products of inertia about axes perpendicular to the spin axis become vanishingly small.

Figure 5:
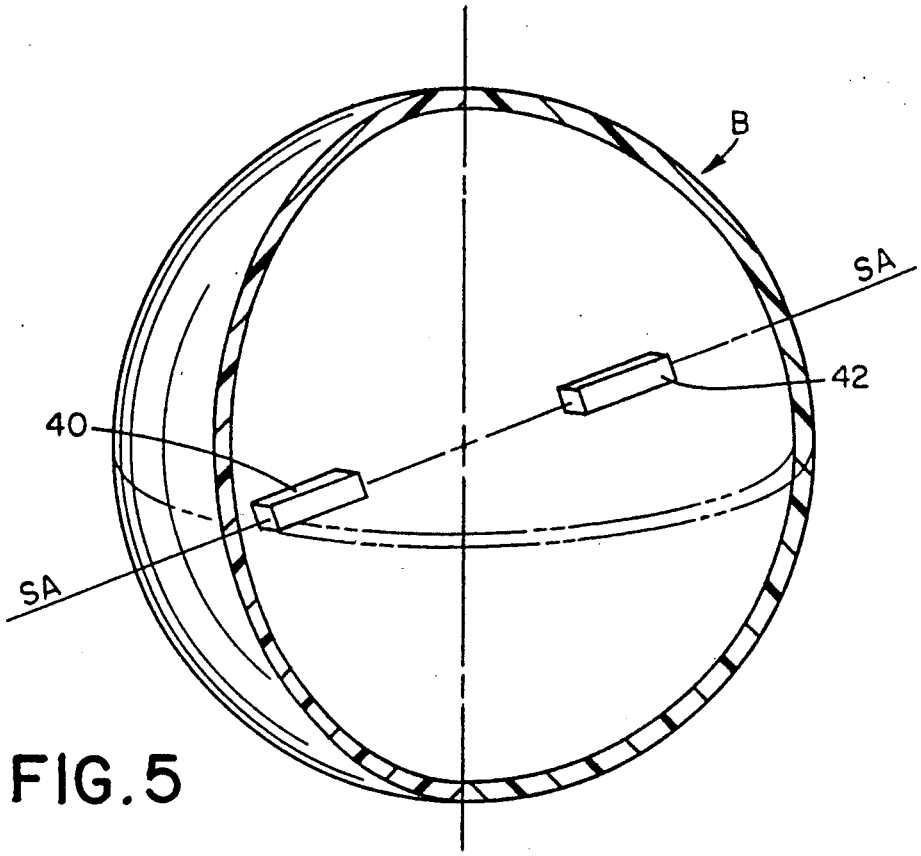
FIG. 5 is a schematic, perspective, partially cross-sectional view of a bowling ball according to the present invention which features weight blocks on the spin axis.
Figure 6:
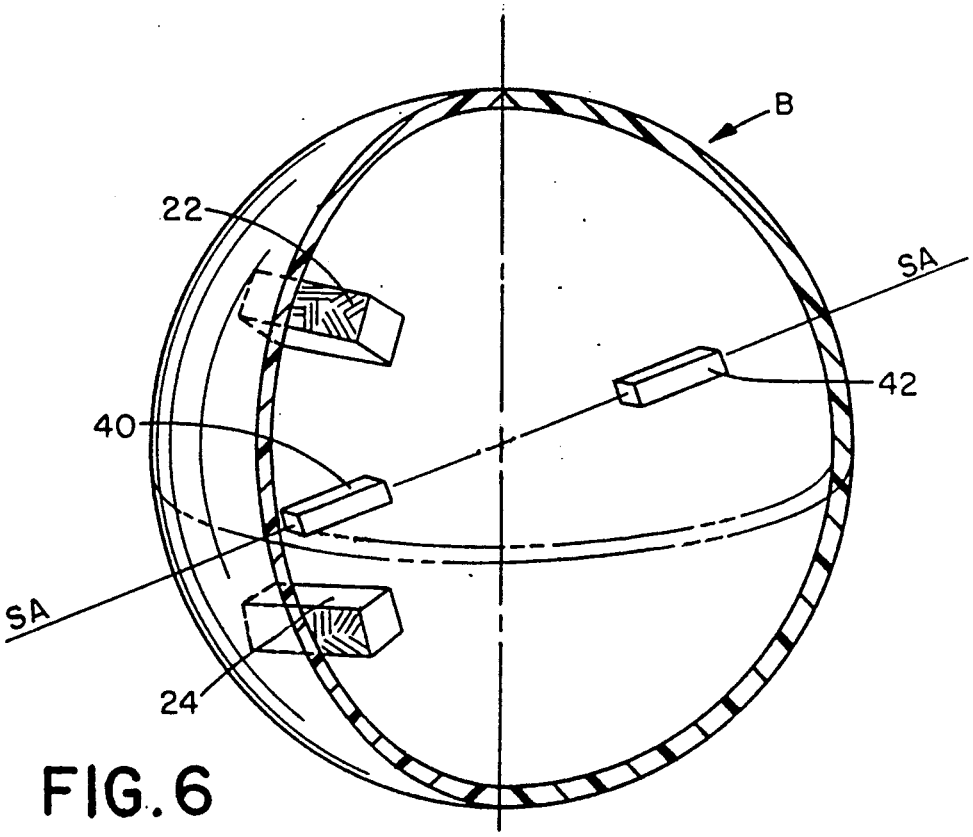
FIG. 6 is a schematic, perspective, partially cross-sectional view of a bowling ball according to the present invention which features weight blocks on the spin axis as well as weight blocks to compensate for the finger holes and thumb holes.

With reference to FIG. 5, a bowling ball B is shown which features weight blocks 40, 42 on the spin axis SA. Alternate embodiments (not shown) of the weight blocks include one weight block positioned between the center of the bowling ball and the outer surface of the cover 28, a plurality of weight blocks evenly distributed on either side of the center of the ball, and a plurality of weight blocks intentionally biased toward one side of the center of the ball. With reference to FIG. 6, the weight blocks 40,42 on the spin axis SA are combined with weight blocks 22, 24 in the preferred embodiment.

Figure 10:
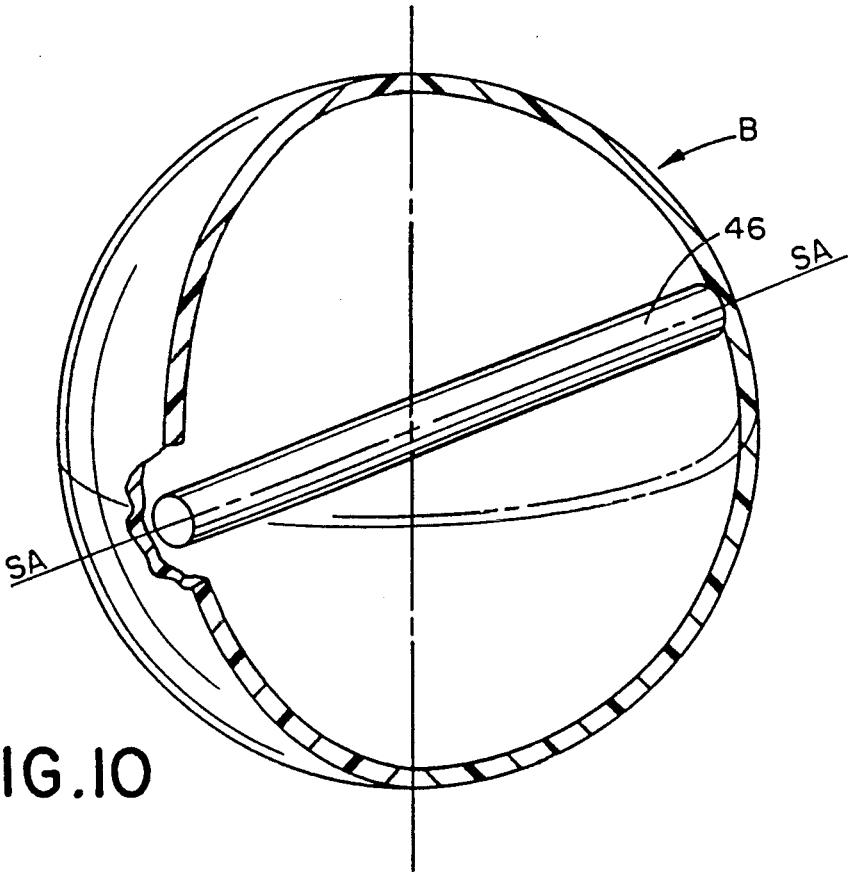
FIG. 10 is a schematic, perspective, partially cross-sectional view of a bowling ball according to the present invention which features a rod on the spin axis.

With reference to FIG. 10, in another embodiment, a rod 46 is located in the interior of the ball so that the centerline of the rod 46 is coincident with the spin axis SA. The rod 46 may either be homogeneous, having an equal weight density along the length of the rod 46, or heterogeneous, having a different weight density on one side of the center of the ball B than the rod 46 has on the other side of the center.

With reference to FIG. 11, one embodiment feature a smaller core 26, a correspondingly thicker cover 28, a rod 46 along the spin axis 5A, and a weight block 64 which occupies the top portion of the core 26. In another embodiment shown in FIG. 12, the weight block 64 is above the core 26 and located near the top of the cover 28.

Figure 13:
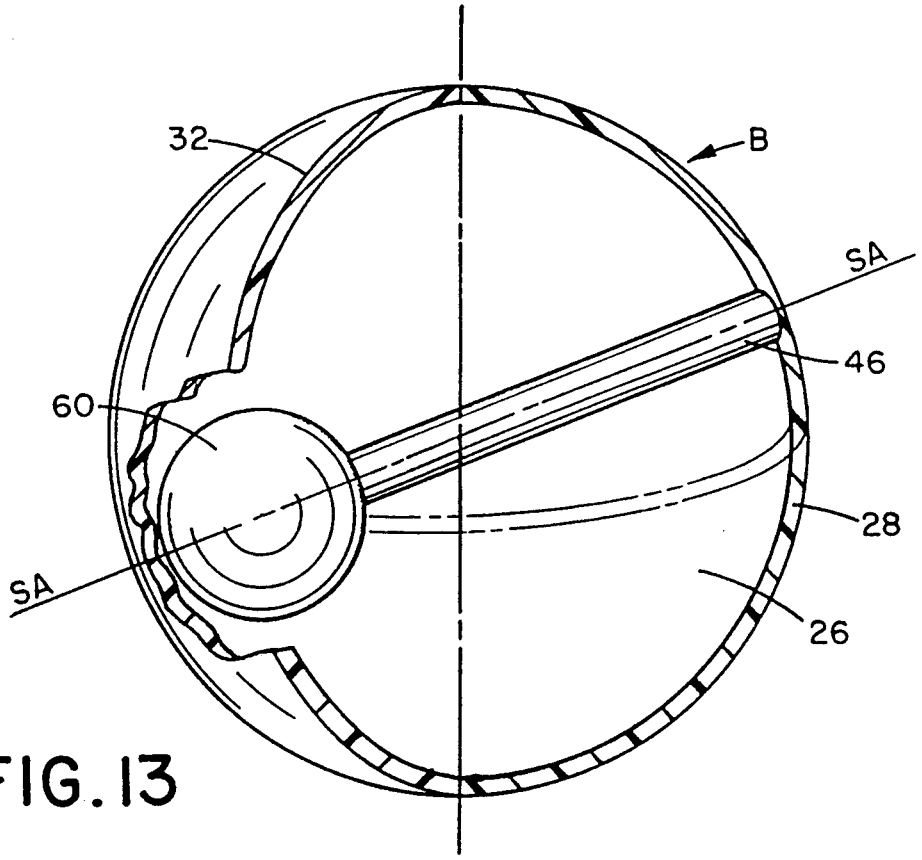
FIG. 13 is a schematic, perspective view of a bowling ball according to another embodiment of the invention.
Figure 14:
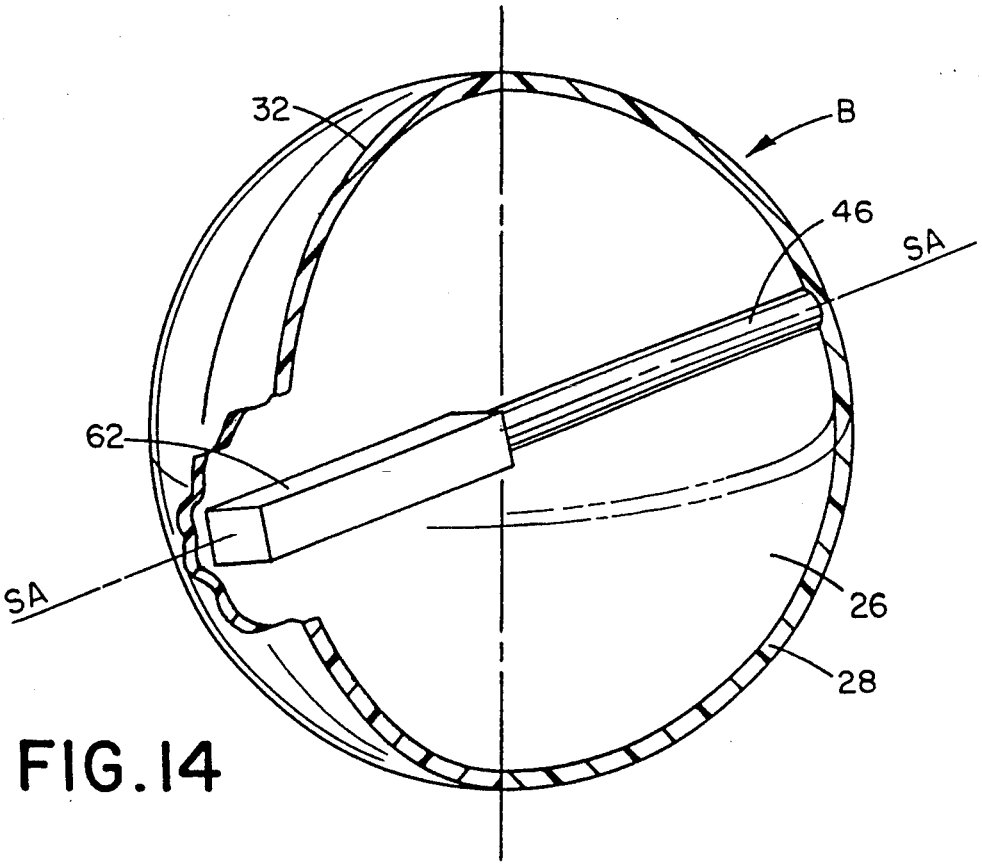
FIG. 14 is a schematic, perspective view of a bowling ball according to another embodiment of the invention; and, FIG. 15 is a schematic, perspective view of a bowling ball according to another embodiment of the invention.
Figure 15:
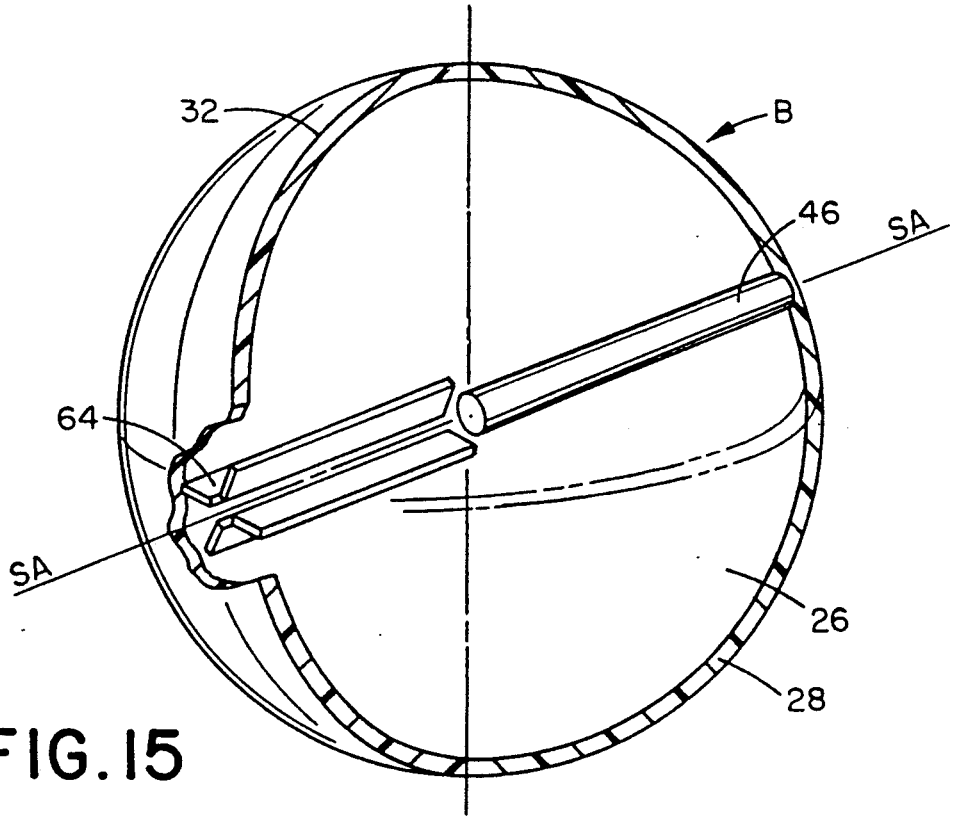

With reference to FIGS. 13–15, alternate embodiments of the invention feature bias weights 60, 62, 64. These bias weight generally extend from one side of the ball's geometric center to the outer surface 32 of the cover 28. The bias weights 60,62, 64 may take the form of spherical weight 60, a rectangular column 62, or spokes 64 emanating from the spin axis 5A.

In the preferred embodiment, one weight block 40, 42 is located on each side of the center of the ball. One of the weight blocks weighs one ounce more than the other weight block. This weight differential is the maximum weight differential allowed by the American Bowling Congress. It is the preferred embodiment because of the precession it puts into the arc of the ball's path.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A bowling ball, the bowling ball having thumb and finger holes for gripping the bowling ball, the bowling ball having a center and when thrown consistently having a ball track plane and a spin axis, the spin axis being perpendicular to the ball track plane, the bowling ball comprising:

a core;

a cover surrounding the core and having an outer surface; and a rod having a length substantially greater than its diameter and extending through and on opposite sides of the center of the ball, the centerline of said rod being coincident with the spin axis, the rod having a homogeneous weight density distribution so that one half of the rod weighs substantially the same as the other half of the rod

2. A bowling ball, the bowling ball having thumb and finger holes for gripping the bowling ball, the bowling ball having a center and when thrown consistently having a ball track plane and a spin axis, the spin axis being perpendicular to the ball track plane, the bowling ball comprising:

a core, a cover surrounding the core and having an outer surface; and, biasing means for biasing the weight density of the bowling ball along the spin axis, the biasing means located on the spin axis and operatively adapted for increasing the precession of the bowling ball, the biasing means being a rod having a length substantially greater than its diameter and extending through and on opposite sides of the center of the ball, the centerline of said rod being coincident with the spin axis, the rod having a heterogeneous weight density distribution so that one half of the rod weighs more than the other half of the rod.

3. The bowling ball of claim 1 or claim 2, wherein the core and cover are of substantially equal weight density throughout.

4. A bowling ball as in claim 1 or claim 2 comprising:

a pair of weight blocks disposed within the bowling ball inwardly of the outer surface of the cover, one of the weight blocks being positioned to be intersected by at least one finger hole the other of the weight blocks being positioned to be intersected by a thumb hole the size and location of the weight blocks being such that there is no concentrated residual weight provided by the weight blocks containing said holes, the weight density of the core, the weight density of the cover and the shape and weight density of the weight blocks being such that after drilling, all axes of the bowling ball may be a spin axis in which the bowling ball's moments of inertia about axes aligned with the spin axis are approximately equal and the products of inertia for all axes perpendicular to the spin axis are small, thereby producing a stable trajectory for the bowling ball as it slides and rolls down a lane.

* * * * *